US005195685A

United States Patent [19]

Dumaine

[11] Patent Number: 5,195,685

[45] Date of Patent: Mar. 23, 1993

[54] GRANULATOR FOR WASTE MATERIAL

[75] Inventor: Thomas J. Dumaine, North Attleboro, Mass.

[73] Assignee: Mediclean Technology, Inc., West Warwick, R.I.

[21] Appl. No.: 772,280

[22] Filed: Oct. 7, 1991

[51] Int. Cl.[5] ..... B02C 1/08; B02C 18/06

[52] U.S. Cl. ..... 241/242; 241/294

[58] Field of Search ..... 241/242, 292.1, 294; 407/33; 144/174, 230

[56] References Cited

U.S. PATENT DOCUMENTS

| | | | |
|---|---|---|---|
| 926,305 | 6/1909 | Utz . | |
| 1,209,319 | 12/1916 | Mitts . | |
| 2,216,612 | 10/1940 | Dimm et al. | 83/6 |
| 3,150,837 | 9/1964 | Hanse et al. | 241/189 |
| 4,000,860 | 1/1977 | Gotham | 241/242 |
| 4,055,309 | 10/1977 | Fleming et al. | 241/221 |
| 4,360,168 | 11/1982 | Peterson, Jr. | 241/294 |
| 4,664,006 | 5/1987 | Mitchell | 241/242 |
| 4,809,915 | 3/1989 | Koffsky et al. | 241/36 |

FOREIGN PATENT DOCUMENTS

| | | | |
|---|---|---|---|
| 1249985 | 3/1989 | Canada | 241/242 |
| 2027362 | 2/1980 | United Kingdom | 241/242 |

*Primary Examiner*—Douglas D. Watts
*Attorney, Agent, or Firm*—Lahive & Cockfield

[57] ABSTRACT

A granulator for waste material having rotating and bed knives respectively mounted for repeated detachment, sharpening and reinstallation with unskilled labor. Accurate predetermined knife gap distances are maintained by the configuration of surfaces on each rotating knife, whereby a cylindrical surface thereon forming the cutting edge is coincident with a cutting cylinder having a fixed location in the frame. Thus the cutting radius is unaffected by sharpening.

5 Claims, 3 Drawing Sheets

GRANULATOR FOR WASTE MATERIAL

SUMMARY OF THE INVENTION

This invention relates generally to rotary granulators for size reduction of materials. Such granulators usually comprise one or more elongate, fixed bed knives and one or more rotating knives cooperating therewith by a chopping or shearing action. More particularly, the invention relates to granulators suitable for unsorted solid waste materials comprising a wide variety of dimensions and physical properties.

Pelletizing, granulating and grinding mills are widely used in industry for comminution of solid bodies to produce Particles of relatively uniform size. The resulting particles have some of the properties of a flowing material, facilitating handling of the solids for measured packaging or industrial processing, as in plastic extrusion. Such granulating equipment is generally designed for optimal use upon particular materials that are frequently or usually of uniform physical properties. A common requirement of such equipment is to produce a consistent particle size. In such industrial applications, the size of the particles produced has wide effects upon subsequent processing. Particle size may be of importance in terms not only of magnitude, but also of consistency throughout each batch of material and from one batch to another or over substantial periods of time. Effects of particle size include changes in the amount of dust created in grinding, changes in the flow rate in extruders receiving the ground materials, and changes in the melt rates of such materials.

To meet the needs for grinding and granulating mills of the foregoing types, it is necessary to maintain precise gap distances between the rotating and bed knives, for example, between 0.004 and 0.006 inch (0.1 to 0.15 mm). Once the appropriate gap distances ave been determined for the particular material and operating conditions, it is necessary to maintain such distances, and to ensure that when the rotating or bed knives are temporarily removed for resharpening, they are again reinstalled to the same gap distances.

It has been generally accepted that the dismounting, sharpening and reinstallation of the knives on such equipment necessarily requires skilled labor in the maintenance of grinders and in the use of gauges or other apparatus and tools when the sharpened knives are reinstalled.

In contrast to such industrial operations, the present invention has as one of its objects the reduction of materials such as waste products, having a wide variety of dimensions and physical properties, to a size or sizes that facilitate either concurrent or subsequent process handling such as sterilization, incineration, packing or other further processing.

A specific application of the invention is the granulation of hospital waste products, including random collections of materials made of papers, fabrics and other solids. The materials may include disposable plastics, glass and nonreusable metal parts such as hypodermic needles. Typically, this application does not require the materials to be reduced to a uniform particle size. Such equipment is generally installed in a facility located within or adjacent to a hospital or clinic, and its use occurs intermittently at variable times dependent upon the rate of collection of waste. After sufficient wear occurs it is necessary to shut down the equipment, remove bed and/or rotating knives, sharpen them and reinstall them in the granulator. Expert labor for these operations is not readily available.

It is therefore a principal object of this invention to provide a granulator for such applications having knives that can be easily removed, resharpened and reinstalled within an acceptable tolerance of accuracy with respect to the gap distances required.

Granulators for waste products are normally fitted with screens having a prescribed mesh and located below the rotating structure and between such structure and the discharge chute. In prior granulator designs, the clearance between this screen an the cutting cylinder described by the cutting edges of the rotating knives varies with each successive resharpening of the knives. For example, in some designs the rotating knives describe a cylinder of progressively smaller diameter with successive sharpening, thereby increasing the screen clearance. In waste grinding applications, this variation can produce significant adverse effects upon the rate of throughput of material. It is therefore a further object of this invention to provide a granulator in which the screen clearance in relation to the cutting radius is constant after repeated resharpening of the bed and rotating knives.

With the foregoing and other related objects in view, the features of this invention include the provision of mounting structures for the bed and rotating knives whereby the location and diameter of the cutting cylinder remain constant after repeated removal, grinding and replacement of knives. The structure includes a rotor having a pair of accurately formed intersecting surfaces serving to locate each rotating knife with precision. Each rotating knife is fabricated with two precisely formed intersecting surfaces and a third precisely formed cylindrical shaped surface, one edge of which forms the cutting edge of the knife. The intersecting surfaces are congruent with the aforementioned pair of intersecting surfaces on the rotor, permitting the knife to be precisely seated with the two pairs of surfaces firmly mated. When the knife is seated, the third surface is coincident with the cylinder generated by the cutting edge as it rotates about the rotor axis, such cylinder hereinafter being called the cutting cylinder.

The grinding of the cutting edge is accomplished without changing the radius of the new cutting edge, which is located on the third surface whether more or less material is removed from such edge in the grinding operation.

In combination with the rotating knife mounting structure, the bed knives are also mounted so that their cutting edges are restored to fixed locations relative to the cutting cylinder without the skillful use of precision gauges or other tools of adjustment, and the initial predetermined knife gap distances are automatically exactly restored.

DETAILED DESCRIPTION

Figure 1:
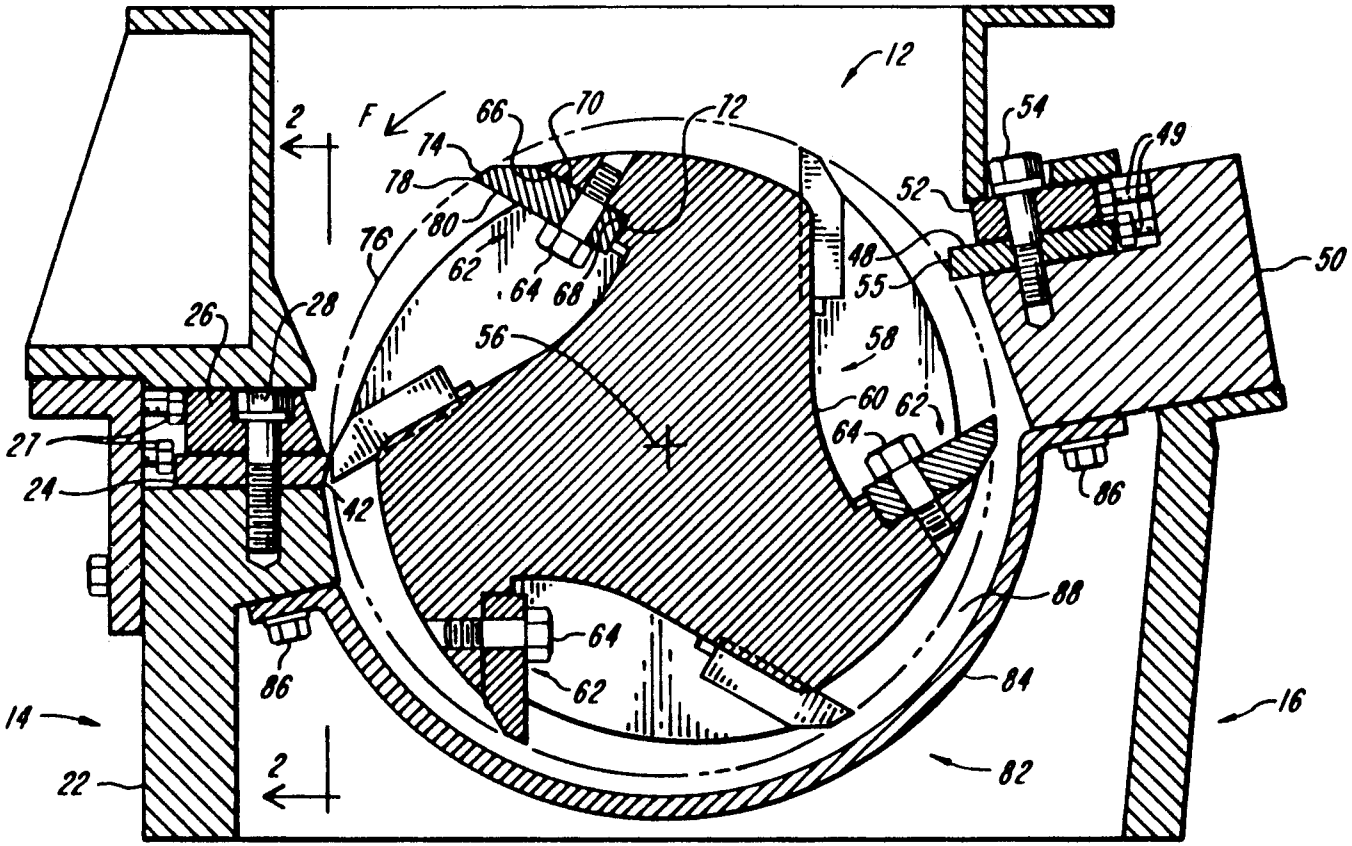
FIG. 1 is a transverse elevation in section normal to the rotating axis of a granulator according to this invention.
Figure 2:
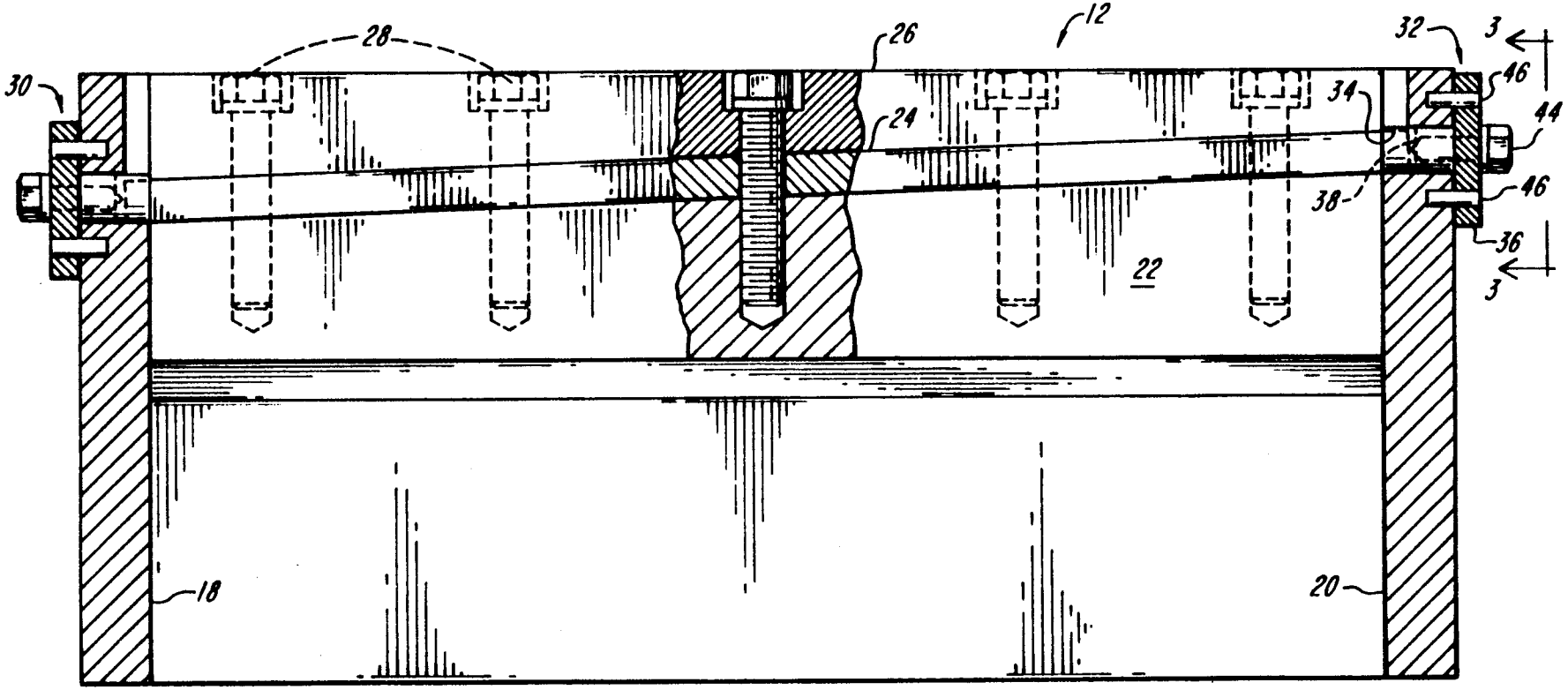
FIG. 2 is a longitudinal elevation in section illustrating the mounting of a bed knife.

Referring to FIGS. 1 and 2, a granulator according to the invention is shown generally at 12. A fixed frame comprises front and back uprights 14 and 16 (FIG. 1) and fixed end uprights 18 and 20 (FIG. 2). The front and back uprights may be fabricated of several parts integrally assembled in the manner shown, or in any other preferred manner providing an equivalent mounting for the bed knives. In the form shown the upright 14 comprises a bed knife seat component 22 having a straight, sloping surface on which a bed knife 24 is received. A tapered holddown plate 26 is received over the bed knife and the knife is clamped between the members 22 and 26 by a plurality of spaced bolts 28. The holes through the bed knife have clearances with the bolts 28, permitting the bed knife to be moved laterally on the surfaces of the members 22 and 26, that is, in the direction from left to right as viewed in FIG. 1. Such movement is accomplished by rotating screws 27 threaded on parts of the frame.

Figure 3:
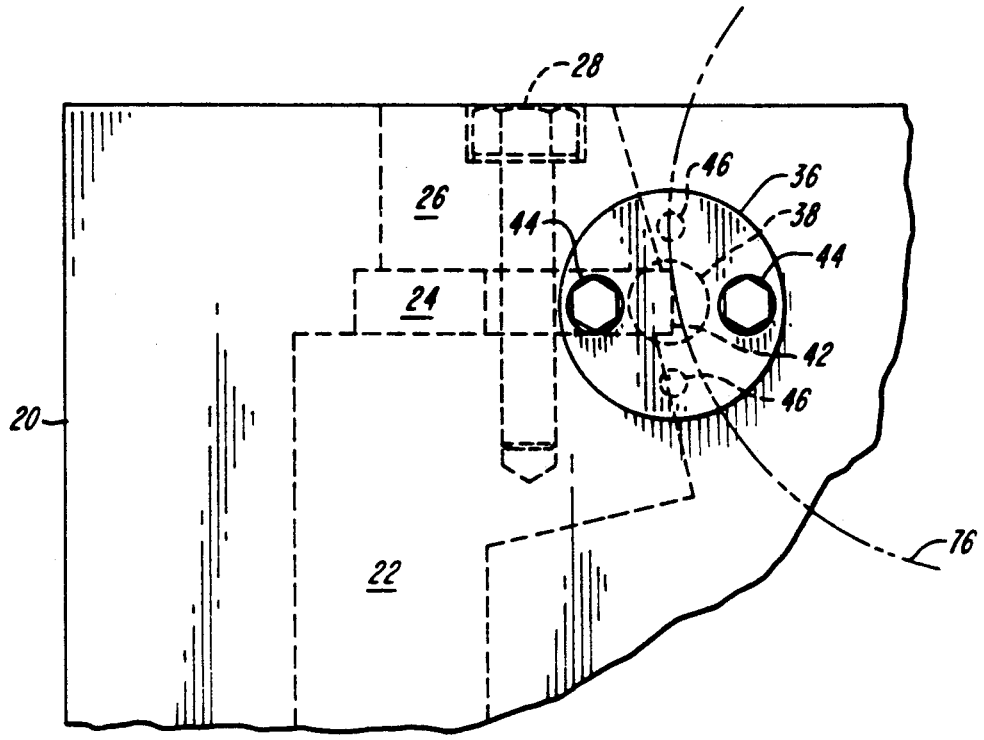
FIG. 3 is a fragmentary elevation taken on line 3—3 of FIG. 2, illustrating the mounting of a bed knife stop.
Figure 4:
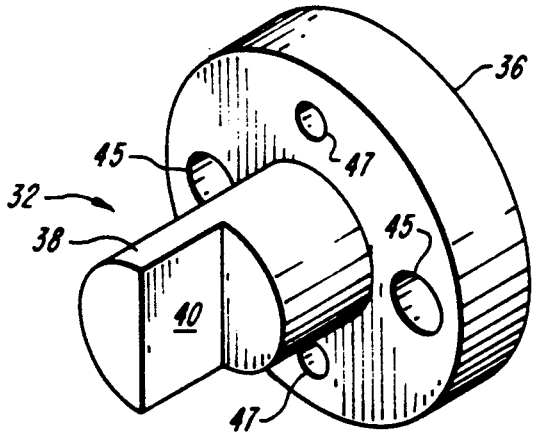
FIG. 4 is a detailed illustration of a bed knife stop.

On the uprights 18 and 20 a pair of bed knife stops 30 and 32 (FIG. 2 to 4) are installed. As these stops are of similar construction, only the stop 32 is further described. As shown in FIG. 2, the upright 20 has a circular thru hole 34. The stop 32 comprises a plate 36 with an integral rod shaped extension 38 extending through the hole. An end portion of this extension is ground to provide a flat surface 40 in position to abut the ground surface 42 of the bed knife 24. The plate 36 is initially loosely fastened to the upright 20 by a pair of mounting screws 44 passing with clearance through holes 45 in the plate. After positioning at initial assembly, a pair of metal dowels 46 are driven through holes 47. The procedure for mounting the bed knife stops by these screws and dowels is hereinafter described in relation to the rotating structures of the granulator.

On the back upright 16 there is provided a structure for mounting a second bed knife 48, provided with adjusting screws 49 corresponding to the screws 27, between a frame member 50 having a sloping surface and corresponding to the member 22, and a tapered holddown plate 52 corresponding to the plate 26, the parts being secured together by spaced bolts 54 corresponding to the bolts 28. Bed knife stops (not shown) are secured to the end uprights 18 and 20 in the same manner as the stops 30 and 32, and abut a ground surface 55 corresponding to the surface 42.

The end uprights 18 and 20 are provided with bearings (not shown) defining a fixed axis 56 (FIG. 1). An elongate rotor 58 formed with a number of longitudinal recesses 60 supports elongate rotating knives 62, each secured by a number of axially spaced bolts 64. Each of the recesses 60 is accurately machined to form a pair of intersecting surfaces 66 and 68, which are orthogonal in the illustrated, preferred embodiment. Each of the rotating knives is also accurately machined with a pair of intersecting surfaces 70 and 72, formed to be precisely congruent with the surfaces 66 and 68, respectively. The two pairs of surfaces are firmly mated when the knife 62 is seated. With the bolts 64 then tightened, a third, accurately machined cylindrical surface 74 on the knife is precisely coincident with the cutting cylinder 76 which it generates about the axis 56. An edge 78 of the surface 74 is the cutting edge of the knife as the rotor rotates in the direction of the arrow F, the edge 78 being parallel to the axis 56 and defined on one side by the cylindrical surface 74 and on the other side by a surface 80 of the knife. Preferably, the surface 80 forms an acute angle with the radius of the rotor passing through the cutting edge 78, to facilitate removal of the particles as they are severed by the knives. Each of the knives 62 is formed and mounted in the identical manner described above.

Figure 5:
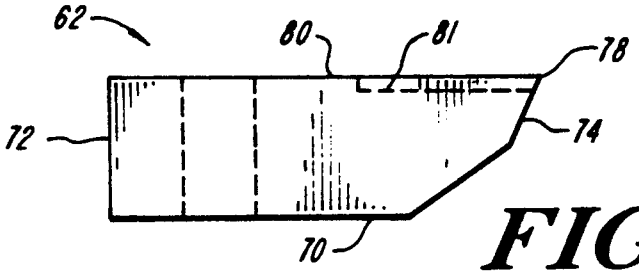
FIG. 5 is a detail view of a rotating knife illustrating the resharpening thereof.

It will be observed by reference to FIG. 5 that grinding of the surface 80 of each knife for sharpening the cutting edge 78 thereby removing an amount of metal as indicated by broken line 81, results in a new cutting edge which, by reason of the above-described structure, is also precisely on the cutting cylinder 76. Thus the rotating knives retain the same radius when sharpened.

A screen 82 having a cylindrical portion 84 is secured to the frame members 22 and 50 by bolts 86. The portion 84 of the screen has its axis coincident with the axis 56, whereby the screen has a predetermined, fixed and uniform clearance 88 from the cutting cylinder 76. Therefore, the cylinder 76 defining the locus of the cutting edges 78 of the knives remains spaced by the constant clearance distance 88 from the screen, regardless of the number of times the knives 62 have been ground or the amount of material removed from the knives by such grinding. This results in uniformity of throughput of material at an optimal rate.

The clearance distance between the rotating and bed knives is accurately set, preferably at the factory, and is not required to be reset under field conditions. To set this clearance at initial assembly, the rotating knives 62 are first installed on their seats, each being tapped back against the surfaces 66 and 68 on the rotor with a soft hammer, and then held in position by tightening the bolts 64 to a specified torque value. This accurately locates the cylindrical surfaces 74 of the knives on the fixed cutting cylinder 76.

The holddown bolts 28 and 54 passing through the bed knives 24 and 48 are loosened, and the adjusting screws 27 are turned while feeler gauges are held between the cutting edges of the bed and rotating knives. The screws 27 are turned to push the bed knives forward until the specified knife gap is obtained, after which the holddown bolts 28 and 54 are tightened to a specified torque value.

While the bed knives are being adjusted as described above, the bed knife stops 30 and 32 are loosely held in position on the frame uprights 18 and 20 by the screws 44 without the dowels 46 being in place. Clearance spaces between the shanks of the screws 44 and the holes 45 in the plates 36 permit movement of the stops toward or away from the rotor. When the clearance gaps between the rotating and bed knives has been set as described above, the surfaces 40 of the bed knife stops are pushed up against the ground faces 42 of the bed knives, and the screws 44 are tightened. Preferably, the gaps between the rotating and bed knives are then rechecked. If the gaps remain correct after the positioning of the bed knife stops, the holes 47 are drilled through the plates 36 and the frame uprights 18 and 20, and the dowels 46 are driven into the holes, thus permanently installing the bed knife stops on the machine uprights. With this method of construction, the surfaces 40 on the stops define a fixed knife gap for the machine.

Once the machine is in service, conditions of use determine the frequency with which it is necessary to grind the cutting edges of the knives. Each time the bed knives 24 and 48 are removed, they are resharpened by grinding the surfaces 42 and 55, and when reassembled on the machine they are pushed by the screws 27 into firm contact with the surfaces 40 on the bed knife stops. Each time the rotating knives 62 are removed for sharpening, they are ground only on the surfaces 80, and when returned to the rotor 58 they are each firmly tapped into place and seated on the surfaces 66 and 68 as previously described.

In the preferred embodiment described, the bed knives 24 and 48 are skewed relative to the axis 56 to provide a shearing action with the rotating knives, thus causing progressive cutting and fragmentation of the materials. However, if desired the bed knives may not be skewed, in which case their cutting edges are parallel to the axis 56.

The number of knives on the rotor and stator is a matter of choice. Also, the invention contemplates the provision of multiple rotors 58 in tandem on a common axis 56, the knives on adjacent rotors being angularly displaced. For example, with two rotors of three knives each coacting with two bed knives, the frequency of cutting impacts per revolution of the rotor is 12, rather than 6, with a consequent reduction in vibration.

I claim:

1. A granulator for size reduction of waste material comprising, in combination, a frame having bearings defining an axis, a rotor mounted in the bearings and having a first pair of accurately formed surfaces intersecting on a line extending along said axis, a rotating knife having a second pair of intersecting surfaces accurately formed to be congruent with said first pair, and a third, cylindrical surface defining a cutting edge and accurately formed to be coincident with a cylinder generated by said edge about said axis when said first and second pairs of surfaces are mated and the rotor is turned, means for detachably securing the rotating knife to the rotor with said pairs of surfaces firmly mated, a bed knife mounted on the frame, extending along said axis and having a cutting edge, means for firmly securing the bed knife to the frame detachably and adjustably relative to said cylinder, and stop means on the frame having a surface located to abut the cutting edge of the bed knife when it is spaced a predetermined gap distance from said cylinder.

2. A granulator according to claim 1, in which each of said first and second pairs of surfaces are orthogonal.

3. A granulator according to claim 1 in which the rotor has a plurality of said first pair of surfaces in angularly spaced relationship, and including a corresponding plurality of said rotating knife and securing means.

4. A granulator according to claim 1, in which the bed knife is supported with its cutting edge skewed at a predetermined angle to said axis.

5. A granulator according to claim 1, in which the frame includes a pair of end uprights having surfaces in planes intersecting said axis, and the stop means comprise a plate on each said surface of each upright, each plate having provision for attachment to said upright adjustably relative said cylinder, and provision for subsequent firm, nonadjustable attachment to said upright with a surface in position to abut the cutting edge of the bed knife at said predetermined gap distance from said cylinder.

* * * * *